US005486990A

United States Patent [19]

Sejkora

[11] Patent Number: 5,486,990

[45] Date of Patent: Jan. 23, 1996

[54] LAMP COVER IN PARTICULAR FOR FLUORESCENT LAMPS

[75] Inventor: Günther Sejkora, Schwarzenberg, Austria

[73] Assignee: Zumtobel Licht GmbH, Austria

[21] Appl. No.: 133,016

[22] PCT Filed: Mar. 27, 1992

[86] PCT No.: PCT/EP92/00684

§ 371 Date: Dec. 8, 1993

§ 102(e) Date: Dec. 8, 1993

[87] PCT Pub. No.: WO92/18805

PCT Pub. Date: Oct. 29, 1992

[30] Foreign Application Priority Data

Apr. 10, 1991 [DE] Germany ..... 9104316 U

[51] Int. Cl.[6] ..... F21V 3/02

[52] U.S. Cl. ..... 362/309; 362/223; 362/336; 362/338

[58] Field of Search ..... 362/336, 308, 362/309, 338, 61, 337, 340, 339, 223

[56] References Cited

U.S. PATENT DOCUMENTS

| | | | |
|---|---|---|---|
| 2,334,005 | 11/1943 | Hoeveler | 362/223 |
| 2,782,297 | 2/1957 | Geissbuhler et al. | 362/336 X |
| 3,431,449 | 3/1969 | Hundley | 362/309 X |
| 3,763,369 | 10/1973 | Lewin | 362/337 X |
| 4,825,346 | 4/1989 | Schindler et al. | 362/311 |
| 4,930,051 | 5/1990 | Golz | 362/336 X |
| 5,040,104 | 8/1991 | Huisingh et al. | 362/339 |
| 5,043,856 | 8/1991 | Levin | 362/336 X |

*Primary Examiner*—Ira S. Lazarus
*Assistant Examiner*—Thomas M. Sember
*Attorney, Agent, or Firm*—Brown, Martin, Haller & McClain

[57] ABSTRACT

A lamp cover in particular for fluorescent lamps consists of a light-transmitting material which at least on one surface features a structure which affects the rays of light that penetrate the material. The present lamp cover is to achieve a soft-focus effect, i.e. light-impervious elements located in the ray path should not be recognizable from the outside. In addition, the lamp cover should have a light-directing effect whereby in the polar diagram in terms of inensity the direction of the light beam hitting the structure in essence has the same direction as the light beam exiting the structure whereby the exiting light beam features a ray expansion. At least on one side of the lamp cover, the surface features a wavelike structure whereby this wavelike structure stretches perpendicularly to the longitudinal axis of the lamp cover and the number of wave trains is in the neighborhood of at least three, preferably ten and maximum a thousand per lamp width, and whereby the wave trains are constantly changing curves whereby these curves are either sine curves or constantly changing radius curves.

11 Claims, 2 Drawing Sheets

$$n = \frac{\sin \alpha}{\sin \beta}$$

LAMP COVER IN PARTICULAR FOR FLUORESCENT LAMPS

BACKGROUND OF THE INVENTION

The present invention relates generally to lamp covers, and is particularly concerned with a lamp cover for a fluorescent lamp. Such lamp covers are known which are transparent or translucent and are appropriate for covering the lamp upward or downward.

The basic problem of such lamp covers is that the light-directing design of the lamp cover must be such that no disturbing shadows occur to the extent that light-impervious objects lie in the ray path and a certain light-directing effect is desired. In addition, the surface on one side of the lamp cover features a certain structure at least on one side.

Some known lamp covers have grooves that run longitudinally to the lamp cover, parallel to one another and at a reciprocal distance from each other, and that form a triangular structure (prism structure) in cross-section (profile). A disadvantage of this known lamp cover with prism structure is that it may bring about striation on illuminated surfaces and that shadowing elements located in the ray path may lead to undesired visibility, i.e. such elements may be readily seen from the outside. To the extent that one wishes to avoid such shadow formations, it is known to opalesce such lamp covers. The disadvantage however is that it produces relatively high diffusion losses. The related disadvantage is that the lamp cover continues to appear bright even from relatively flat angles of view, which is undesirable in many applications.

It also contradicts the appropriate norm.

In addition, such opal material also diffuses back into the lamp, which leads to efficiency losses.

SUMMARY OF THE INVENTION

It is an object of the present invention to improve a lamp cover as described above that achieves a targeted ray expansion without diffusion losses with a kind of soft-focus effect but without using an opal structure.

According to the present invention, a lamp cover is provided which comprises a cover member having opposite inner and outer surfaces and a longitudinal axis, at least one surface having a wavelike structure which stretches perpendicularly to the longitudinal axis of the lamp cover and the number of wave trains is in the neighborhood of at least three, preferably ten and maximum a thousand per lamp width, and whereby the wave trains are constantly changing curves whereby these curves are either sine curves or constantly changing radius curves. Accordingly, the wave-like structure forms grooves which run longitudinally and parallel to the longitudinal axis of the fluorescent lamp.

In other words, essential characteristic of the present invention is that the structure in accordance with the invention achieves a sort of soft-focus effect, i.e. it produces a "ray expansion" which refers to the following.

Starting with a narrow beam of light that hits the structure (the term "narrow beam" refers to a curve in the polar diagram of intensity), the beam of light is expanded and widened in the same direction when shining through the structure without producing additional diffusion parts.

This is the essential advantage of the present invention in comparison to the prism structures mentioned earlier in that beam direction is in the foreground in the known prism structures and in that the diffusion portion is diffuse in the opal structures, i.e. a relatively big efficiency loss must be taken into the bargain. In other words, the incoming light beam has a different direction in prism structures as the outgoing light beam.

Important feature of the present invention is that barely translucent objects located in the beam of light are difficult to see from the outside as a result of the soft-focus effect in accordance with the invention, and that shadows and streaks that would occur on the illuminated surface are prevented.

Another significant advantage of the present invention is that the lamp cover in accordance with the invention is able to produce a targeted radiation (beam) in a very specific area so that when viewing the lamp cover from a flat angle it appears dark because there is no longer any reflection in such flat reflection areas.

Such a lamp cover is preferably used for covering a fluorescent lamp whereby the prerequisite is that the described structures (grooves) extend parallel in their longitudinal axis to the longitudinal axis of the fluorescent lamp.

BRIEF DESCRIPTION OF THE DRAWING

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENTS

Figure 1:
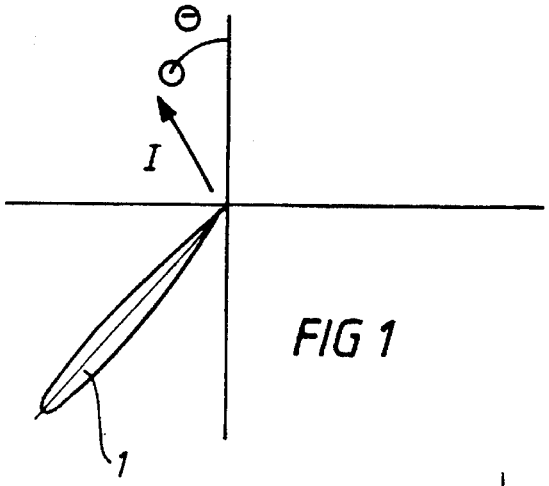
FIG. 1 shows the polar diagram of the intensity of a beam of light that hits the structure.

FIG. 1 is a polar diagram illustrating intensity of a beam of light 1 hitting a translucent structure. The light beam 1 is relatively narrow in the polar diagram, i.e. it is strongly directed in terms of intensity.

Figure 2:
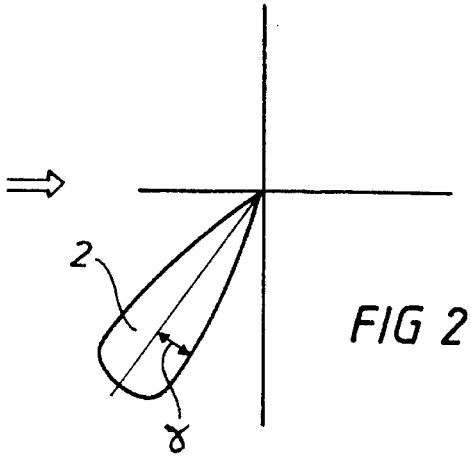
FIG. 2 shows the polar diagram of the intensity of a beam of light exiting the structure.

FIG. 2 shows the achievement of the present invention, i.e. a light beam 2 exiting the structure is strongly directed but features a certain ray expansion whereby the angle gamma represents half of the desired ray expansion.

It is important that even the light beam 2 that exits the structure is directed relatively strongly and in essence does not contain any diffused parts. In addition, it is essential that it is directed in the same direction as the incoming light beam 1 whereby the lamp cover in accordance with the invention produces a directed light, unlike opal covers, which only diffuse. In addition, there is also a difference with the previously mentioned prism structures because such prism structures do not produce any ray expansion but only a ray deflection, i.e. the incoming light beam is deflected in a different direction. This is not the purpose of the present invention.

In other words, the described ray expansion achieves the previously described soft-focus effect so that a priori disturbing striations and shadow formations on illuminated walls may be avoided.

Figure 3:
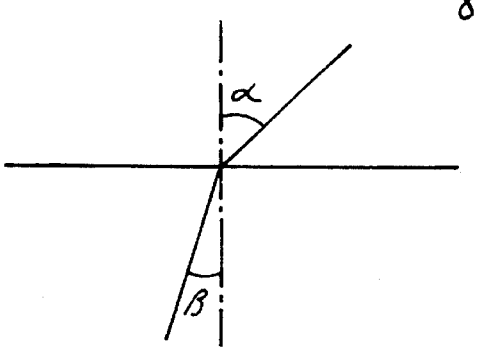
FIG. 3 represents the refraction on a refracting surface.

Referring to the drawings that follow, the following parameters are defined:

$\gamma$=half angle of ray expansion $\alpha$=maximum deviation from parallel plate are $\beta 1$, $\beta 2$=refraction angle h=half depth of structure a=half width of structure FIG. 3 shows in a general way the refraction law when a certain light beam at an angle alpha hits a refracting surface and exits same at an angle beta.

n is the refraction index.

Applicable is the formula $$n = \frac{\sin \alpha}{\sin \beta}$$

Figure 4:
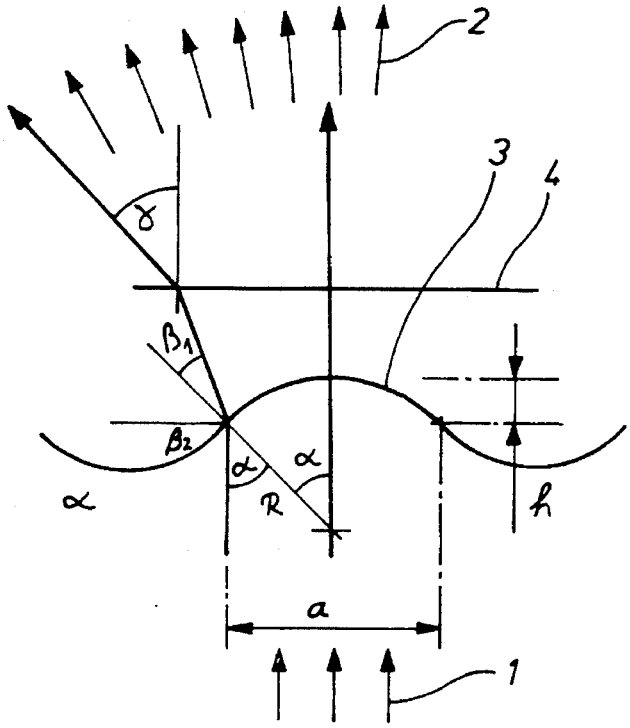
FIG. 4 shows the light refraction of a portion of a refracting structure.

FIG. 4 shows a wavelike structure 3 whereby this structure forms the surface of the lamp cover.

Parameter a defines half the width of the structure while parameter h defines half the depth of the structure.

When a ray-emitting light beam 1 hits the wavelike structure 3 from below, the light beam 2 exits the structure 3 as shown in FIG. 4 whereby the angle gamma represents half of the ray expansion, i.e. the parallel light beam 1 hitting below the structure is expanded on each side by the angle gamma after passing through the structure 3.

One recognizes that the angle alpha is the maximum allowable angle, which describes the maximum allowable deviation of the wavelike structure 3 from a parallel plate 4.

In other words, the angle alpha must also be considered as the maximum allowable tangent angle on the wavelike structure 3.

The angle alpha follows the following formula:

$$\sin \alpha = \frac{\frac{4h}{a}}{1 + \frac{4h^2}{a^2}}$$

Figure 5:
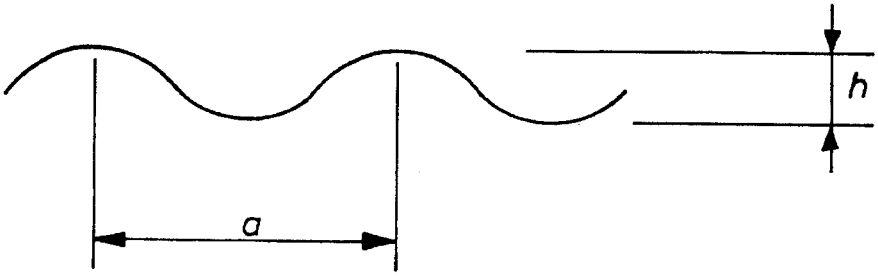
FIG. 5 shows a sample application of a refracting structure with indication of size.

FIG. 5 illustrates one example of a wavelike structure 3. The above formula describes dimensions for the wavelike structure, and a few possible values for different wavelike structures are calculated below as follows:

| | | | |
|---|---|---|---|
| $\gamma$ Expansion angle: | ±4° | ±7° | ±10° |
| Half width of structure *a*: | 4 | 4 | 4 |
| Height *h*: | 0.12 | 0.21 | 0.30 |

The following defines the correlation between the angle alpha, the angle gamma and the refraction index.

$$\gamma = \arcsin\left[ n \cdot \sin\left[ \alpha - \arcsin\left( \frac{\sin\alpha}{n} \right) \right] \right]$$

The example in accordance with FIG. 5 and the above values start with lamp cover made of Macrolon material with a refraction index of n=1.586.

Figure 6:
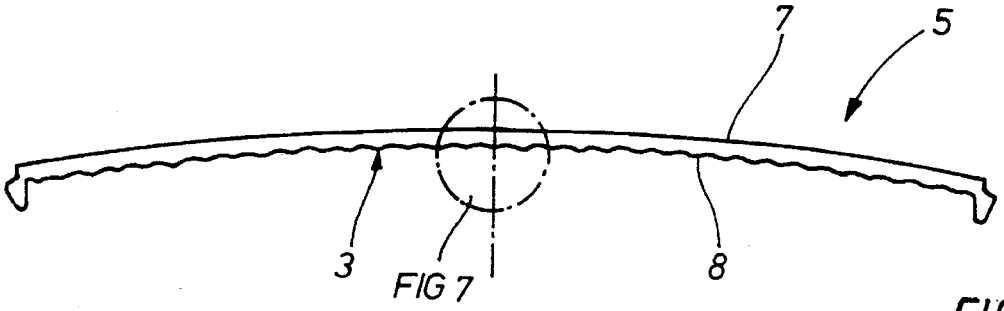
FIG. 6 is a front view of a lamp cover in accordance with a preferred embodiment of the invention.
Figure 7:
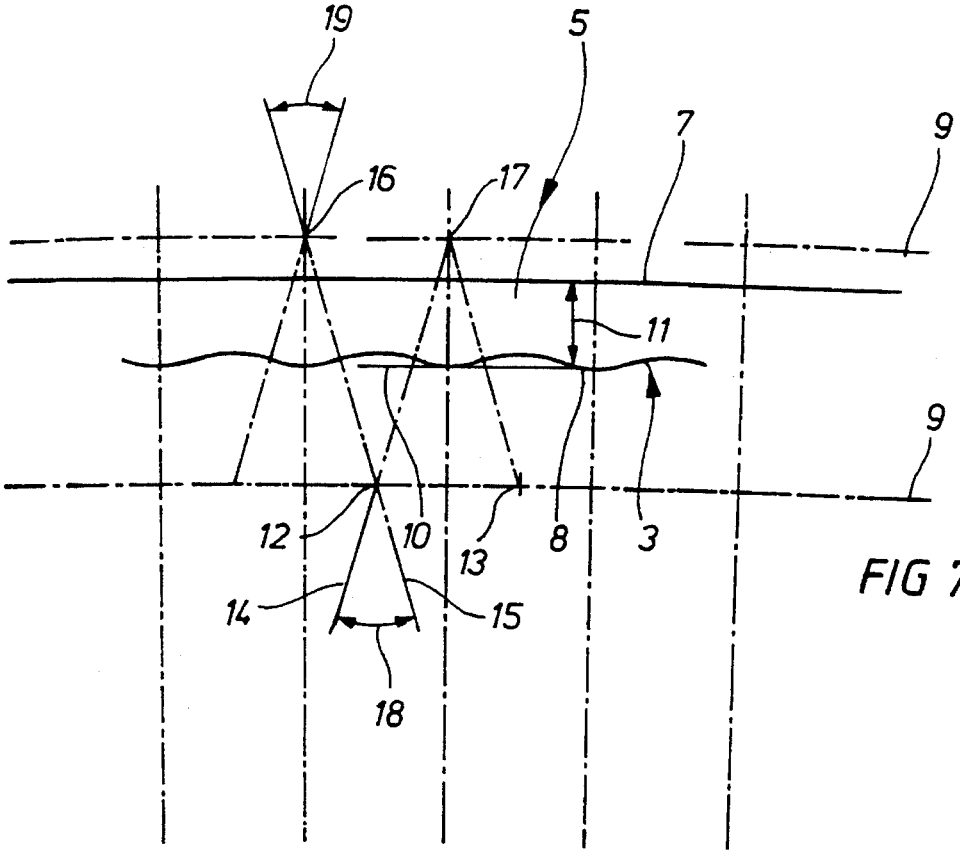
FIG. 7 shows a larger cross-section of the lamp cover in accordance with FIG. 6.

FIGS. 6 and 7 show a complete example for such a lamp cover 5.

FIG. 6 illustrates a lamp cover 5 according to a preferred embodiment of the invention having an upper or outer side or surface 7 away from the lamp. The upper surface 7 is smooth to keep it clean. The lower side (the side 8 turned towards the lamp) features the wavelike structure 3 described above.

Although only the inner surface 8 features a wavelike structure in the illustrated embodiment, both the upper surface 7 and the lower surface 8 may feature such a wavelike structure in alternative embodiments.

Additionally, although the lamp cover in FIG. 6 is positioned above the lamp itself, it will be understood that the cover may be used in a number of different possible orientations and in a wide variety of known lighting applications. Thus, the cover may be positioned below a lamp facing downward or may be positioned to one side of a lamp. The cover may be extended to completely enclose a lamp on all sides, if necessary.

FIG. 7 illustrates further details of wavelike structure 3 of FIG. 6.

In this case, the sine function calculated earlier was approximated by corresponding radius curves. Starting with a reference line 9, radius segments with a radius of 3.6 mm (starting from reference line 9) are joined together in succession in a constant series.

It is important that the "wave peaks" shown in FIG. 7 concern those radius segments which originate in the lower reference line 9 while the "wave valleys" shown in FIG. 7 start from the upper reference line 9.

The reference lines 9 are symmetrical to an average surface 10.

The material depth 11 of 2.4 mm for example may vary widely and depends on the material properties of the material used.

Points 12 and 13 describe the distance between two wave peaks whereby straight lines 14, 15 run through these points 12, 13 and intersect in the opposite points 16, 17 of the opposite reference line.

The angle 18 between the straight lines 14, 15 is for example 33,42°.

Since the entire cover is curved spherically in accordance with FIG. 6, the upper angle 19 has a value for example of 32.91°.

In other words, the present invention concerns the use of a "targeted" groove structure in a lamp cover described in the present embodiment only for use with a fluorescent lamp. The present invention however also encompasses applications for other lights such as halogen lamps or incandescent lamps.

When using such lighting devices, the groove structures would not run parallel to the longitudinal axis of the fluorescent lamp described earlier but the groove structures would be concentric groove structures or local concentric groove structures whereby such ringlike structures are spread over the surface of a lamp cover.

It must be noted that preferred dimensions for the wavelike structure exist whereby the upper limit is only a function of the technical properties of the material and of the tool used to apply the wavelike structures. This means that also for example a thin foil can be used instead of the lamp cover made of Macrolon whereby the wavelike structures described earlier are formed in this structure in the micrometer range.

Although a preferred embodiment of the present invention has been described above by way of example only, it will be understood by those skilled in the field that modifications may be made to the disclosed embodiment without departing from the scope of the invention, which is defined by the appended claims.

I claim:

1. A lamp cover particularly for a fluorescent lamp, comprising:

an elongate cover member of light-transmitting material having a longitudinal axis, an outer surface and an inner surface;

one of said inner or outer surfaces of the cover member being of wavelike structure comprising alternating wave peaks and troughs which are oriented substantially parallel to the longitudinal axis of the cover member;

the wavelike structure comprising at least three wave trains and comprising means for expanding a light beam to a predetermined expansion angle;

the light-transmitting material having a refractive index n, the wave train having a tangent with a maximum gradient to a parallel plate at an angle α, and a light beam exiting the cover member having a half angle γ of ray expansion which satisfies the following relation:

$$\gamma = \arcsin\left[ n \cdot \sin\left[ \alpha - \arcsin\left( \frac{\sin\alpha}{n} \right) \right] \right]; \text{ and}$$

the wave structure having a half width of 4 mm, a half depth of 0.12 mm, and the light beam exiting the cover member having a half angle of ray expansion of 4°, respectively.

2. The cover as claimed in claim 1, wherein the wavelike structure comprises between ten and one thousand wave trains.

3. The cover as claimed in claim 2, wherein the wavelike structure comprises ten wave trains.

4. The cover as claimed in claim 1, wherein the wavelike structure comprises sine waves.

5. The cover as claimed in claim 1, wherein the wavelike structures comprise curves of constantly changing radius.

6. The cover as claimed in claim 1, wherein the lamp cover material is Polycarbonate with a refraction index of n=1.586.

7. The cover as claimed in claim 1, wherein the material of the cover member is transparent.

8. The cover as claimed in claim 1, wherein the material of the cover member is opal-colored.

9. The cover as claimed in claim 1, wherein the wave-like structure is opalesced.

10. A lamp cover particularly for a fluorescent lamp, comprising:

an elongate cover member of light-transmitting material having a longitudinal axis, an outer surface and an inner surface;

one of said inner or outer surfaces of the cover member being of wavelike structure comprising alternating wave peaks and troughs which are oriented substantially parallel to the longitudinal axis of the cover member;

the wavelike structure comprising at least three wave trains and comprising means for expanding a light beam to a predetermined expansion angle;

the light-transmitting material having a refractive index n, the wave train having a tangent with a maximum gradient to a parallel plate at an angle α, and a light beam exiting the cover member having a half angle γ of ray expansion which satisfies the following relation:

$$\gamma = \arcsin\left[ n \cdot \sin\left[ \alpha - \arcsin\left( \frac{\sin\alpha}{n} \right) \right] \right]; \text{ and}$$

the wave structure having a half width of 4 mm, a half depth of 0.21 mm, and the light beam exiting the cover member having a half angle of ray expansion of 7°, respectively.

11. A lamp cover particularly for a fluorescent lamp, comprising:

an elongate cover member of light-transmitting material having a longitudinal axis, an outer surface and an inner surface;

one of said inner or outer surfaces of the cover member being of wavelike structure comprising alternating wave peaks and troughs which are oriented substantially parallel to the longitudinal axis of the cover member;

the wavelike structure comprising at least three wave trains and comprising means for expanding a light beam to a predetermined expansion angle;

the light-transmitting material having a refractive index n, the wave train having a tangent with a maximum gradient to a parallel plate at an angle α, and a light beam exiting the cover member having a half angle γ of ray expansion which satisfies the following relation:

$$\gamma = \arcsin\left[ n \cdot \sin\left[ \alpha - \arcsin\left( \frac{\sin\alpha}{n} \right) \right] \right]; \text{ and}$$

the wave structure having a half width of 4 mm, a half depth of 0.30 mm, and the light beam exiting the cover member having a half angle of ray expansion of 10°, respectively.

* * * * *